United States Patent [19]

Willis

[11] Patent Number: 4,662,618

[45] Date of Patent: May 5, 1987

[54] INTEGRALLY-MOLDED UNITARY SUPPORTING MEMBER FOR WOOD CLAMP

[75] Inventor: Gregory H. Willis, Hampstead, Md.

[73] Assignee: C. B. & W. Tools, Inc., Timonium, Md.

[21] Appl. No.: 690,203

[22] Filed: Feb. 20, 1985

Related U.S. Application Data

[63] Continuation-in-part of Ser. No. 623,929, Jun. 25, 1984, abandoned.

[51] Int. Cl.[4] ..... B25B 1/00

[52] U.S. Cl. ..... 269/43; 269/156; 269/277

[58] Field of Search ..... 269/43, 156, 254 R, 269/287, 277; 248/214, 219.1, 219.3, 218.4, 219.4

[56] References Cited

U.S. PATENT DOCUMENTS

| | | | |
|---|---|---|---|
| 1,054,386 | 2/1913 | Barton | 269/249 X |
| 1,471,118 | 10/1923 | Gething | 269/156 X |
| 1,710,718 | 4/1929 | Stotz | 269/156 |
| 1,808,628 | 6/1931 | Bond | 248/214 |
| 2,627,113 | 2/1953 | Moray | 269/249 X |
| 2,928,443 | 3/1960 | Sevachko | 269/287 X |
| 3,958,788 | 5/1976 | Feibelman | 248/214 |
| 4,427,191 | 1/1984 | Hess | 269/43 |
| 4,552,345 | 11/1985 | Benda et al. | 269/43 |

FOREIGN PATENT DOCUMENTS

| | | | |
|---|---|---|---|
| 245127 | 6/1960 | Australia | 269/156 |
| 1092074 | 12/1980 | Canada | 248/214 |
| 552421 | 12/1956 | Italy | 269/156 |

*Primary Examiner*—Frederick R. Schmidt
*Assistant Examiner*—Steven P. Schad
*Attorney, Agent, or Firm*—Leonard Bloom

[57] ABSTRACT

A unitary supporting member (integrally molded of urethane) is carried by a vise bar and is lodged between the vise bar and a wooden workpiece, thereby protecting the workpiece from being marred or scratched. The member is substantially homogeneous, is substantially devoid of internal reinforcements, and has a central recess having a plan outline corresponding substantially to a cross-section of the vise bar.

5 Claims, 25 Drawing Figures

INTEGRALLY-MOLDED UNITARY SUPPORTING MEMBER FOR WOOD CLAMP

CROSS-REFERENCE TO RELATED APPLICATION

The present invention constitutes a continuation-in-part to my pending application, Ser. No. 623,929 filed June 25, 1984, now abandoned, and entitled "Removable Support Clip For Wood Vise", the disclosure of which is incorporated herein by its entirety.

FIELD OF THE INVENTION

The present invention relates to a support clip for a wood clamp vise or the like, and more particularly, to a removable clip which supports the workpiece (or workpieces) in a plane transversely of the vise jaws.

BACKGROUND OF THE INVENTION

In the prior art, various clamps and vises are used to rigidly retain one or more workpieces on which work is to be performed.

For example, a wood vise may be used to hold several workpieces together in a gluing operation. One such vise consists of a fixed jaw, a movable jaw, and a longitudial bar or rod therebetween. A threaded rod is carried by the fixed jaw, and the rod has an abutment for engaging a side edge of the workpiece(s). The opposite side edge of the workpiece(s) engage a corresponding abutment on the movable jaw. The rod is actuated by a suitable crank carried by the fixed vise jaw.

When using this type of vise, the workpiece(s) may inadvertently contact the vise bar and become scratched or otherwise marred. This problem is especially aggravating to the craftsman, since hobbycraft woods or other expensive materials are frequently used.

Moreover, when several workpieces are alined with one another and are positioned within the vise, and when the threaded rod is tightened to rigidly retain the workpieces, the continued pressure of the threaded rod under actuation by the crank causes the workpieces to "bow" somewhat, so that the finished article will not be completely planar or "true". This situation becomes more pronounced when the workpieces are relatively thin or are relatively soft. Besides, it is difficult to control the degree of clamping pressure.

SUMMARY OF THE INVENTION

Accordingly, it is an object of the present invention to alleviate the disadvantages and deficiencies of the prior art by providing a removable support clip for optional usage between the longitudinal vise bar and the workpiece.

It is another object of the present invention to provide a removable support clip that will not mar the finish of the workpiece.

It is yet another object of the present invention to provide a removable support clip that will not adhere to the glues, adhesives, lacquers, varnishes, finishes or other materials normally used on workpieces clamped within the vise.

It is yet still another object of the present invention to provide a plurality of removable clips that support the workpieces and preclude "bowing" of the composite assembly of the workpieces.

It is a further object of the present invention to provide removable support clip(s) that will facilitate improved control over the degree of clamping pressure executed by the vise.

It is a still further object of the present invention to provide a removable support clip that is sufficiently flexible to conform to a curved adjacent surface of the workpiece (either convex or concave) yet has sufficient "memory" so as to return to its original position.

It is a further object of the present invention to provide a removable support clip that may be manufactured economically for widespread distribution and usage by professional woodworkers, hobbycrafters and do-it-yourselfers.

It is, again, a further object of the present invention to provide a removable support clip that may be used easily and conveniently.

In accordance with the teachings of the present invention, a preferred embodiment thereof is disclosed and illustrated herein, in which a support clip is adapted to be disposed between the longitudinal vise bar and the workpiece. The support clip includes a member which engages the workpiece, and a pair of resilient legs are carried by the member and depend therefrom. These legs are spread apart sufficiently to straddle the bar, thereby supporting the workpiece in a plane transversely of the vise jaws, precluding substantial bowing of the workpiece, and preventing the workpiece from being marred by inadvertent contact with the vise bar.

In accordance with the further teachings of the present invention, the member comprises a substantially oblong bar of molded material, thereby precluding any marring of the finish of the workpiece. Preferably, the molded material is urethane, which is a non-stick material that will not adhere to the glues, adhesives, finishes or other materials normally used on workpieces clamped in the vise. A plate is molded within the oblong bar, and the resilient legs have respective inner portions secured to the plate. These legs further have respective outer portions which are turned inwardly towards one another, such that the outer portions are substantially adjacent to each other. The outer portions of the legs have respective ends which are turned away from one another, whereby the support clip may be guided on the vise bar, and whereby the vise bar cams the resilient legs apart by a downward push on the support clip.

In the usual application, a plurality of workpieces are clamped between the vise jaws; and preferably, a corresponding plurality of support clips are provided, one for each of the workpieces.

In accordance with the still further teachings of the present invention, the resilient legs are connected to the oblong bar by means of a swivel joint, thereby accommodating any misalignment or tolerance accumulations between the wood vise, the workpieces, and the support clip of the present invention.

In accordance with the yet still further teachings of the present invention, the support clip is completely molded from a suitable material, preferably a lesser-density urethane, and may be molded around a supporting metal-spring structure, if desired.

The aforementioned improvements find particular utility in combination with a wood vise having a vise bar and further having respective jaw means for clamping at least one workpiece therebetween.

A still further improvement comprises an integrally-molded unitary supporting member carried by the vise bar, lodged between the vise bar and the workpiece, and having a surface engageable with the workpiece. The unitary member is substantially homogeneous, is substantially devoid of internal reinforcements, and has a central recess having a plan outline corresponding substantially to a cross-section of the vise bar.

In a first embodiment of this still further improvement, the unitary member has a flat top and is substantially semi-circular. The central recess in the member is slotted, thereby forming a pair of resilient legs in the member. These legs may be spread apart to mount the member on the vise bar laterally thereof; and since the plastic member has inherent resiliency, the legs spring back to grip the vise bar. The plan outline of the central recess in the member is substantially T-shaped to conform to the cross-section of the particular vise bar.

In a second embodiment thereof, the T-shaped recess includes an elongated stem portion having concave inner surfaces confronting one another.

In a third embodiment thereof, the recess is substantially rectangular.

In a fourth embodiment thereof, the recess is substantially circular.

In a fifth embodiment of this still further improvement, the unitary member is substantially toroidal and has a circular central recess to conform to the round cross-section of the vise bar. In this embodiment, the member is received end-wise over the vise bar.

These and other objects of the present invention will become apparent from a reading of the following specification, taken in conjunction with the enclosed drawings.

GENERAL DESCRIPTION OF THE PREFERRED EMBODIMENT

Figure 1:
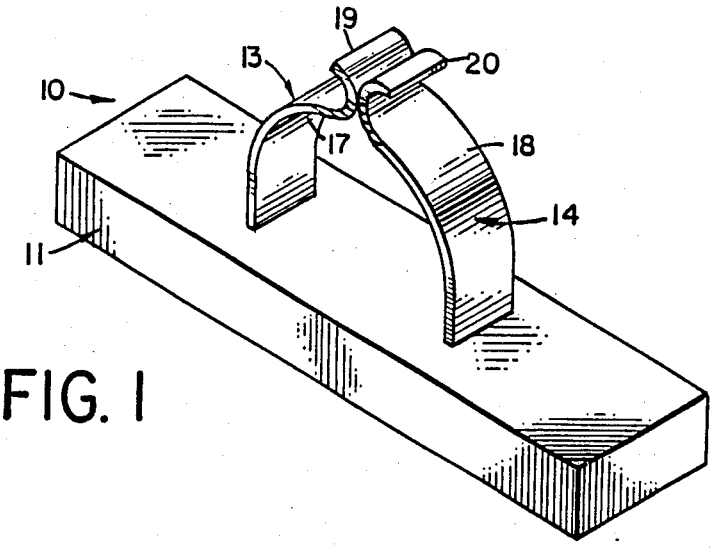
FIG. 1 is a perspective of the support clip of the present invention, showing the pair of resilient legs extending from a molded oblong bar.
Figure 2:
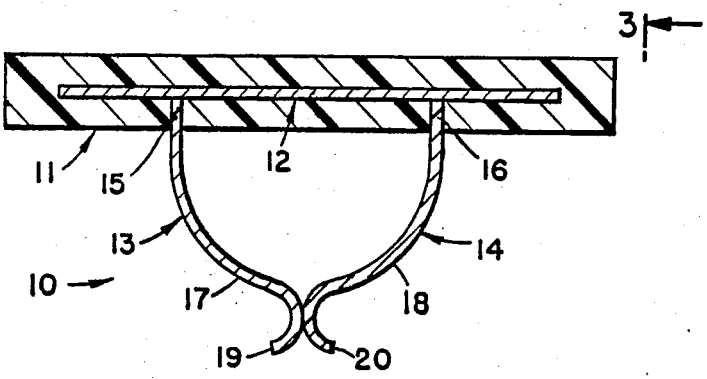
FIG. 2 is a front elevation of the support clip in its usual disposition, reversed from the showing in FIG. 1, drawn to an enlarged scale, and with parts broken away and sectioned.
Figure 3:
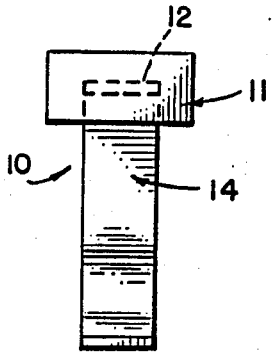
FIG. 3 is an end elevation of the support clip, taken along the lines 3—3 of FIG. 2.

With reference to FIGS. 1-3, the support clip 10 of the present invention includes a substantially oblong member or bar 11 which may be molded from a suitable plastic material, which is preferably a relatively high-density urethane. Urethane is preferred since it is a non-stick material that will not adhere to the glues, adhesives, lacquers, varnishes, finishes or other materials normally used on workpieces clamped with a wood vise. A plate 12 is molded integrally within the oblong bar. A pair of resilient legs 13 and 14 have inner ends 15 and 16, respectively, which are suitably anchored to the plate (prior to the molding process). Preferably, the plate and the legs are formed from relatively-thin spring steel. These legs also have respective outer portions 17 and 18 which are turned inwardly towards one another, such that the distance therebetween is less (and preferably, substantially less) than the corresponding distance between the respective inner ends of the legs. In the preferred embodiment, the outer portions of the respective resilient legs are substantially adjacent to each other (and touch each other) as shown more clearly in FIG. 2. These outer leg portions also have respective ends 19 and 20 which are turned outwardly from one another.

Figure 4:
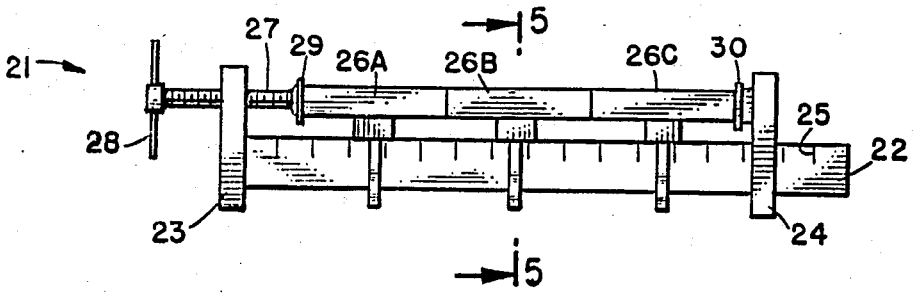
FIG. 4 is a side elevation of a typical wood vise with which the teachings of the present invention may find particular utility, showing a plurality of support clips for a corresponding plurality of workpieces secured within the vise.

With reference to FIG. 4, a typical wood vise 21 is illustrated with which the support clip of the present invention may find particular utility, it being understood that the invention is equally applicable to a wide variety of vises, clamps, jigs and fixtures. With this in mind, the vise includes a longitudinal vise bar 22, a fixed jaw 23 secured thereto, and a movable jaw 24. The movable jaw cooperates with special slots 25 (or other indexing means) formed on the top (or side) of the vise bar, such that the movable jaw may ratchet with respect to the vise bar in a "coarse" adjustment of the vise relative to the workpiece. In FIG. 4, three workpieces 26A, 26B and 26E are illustrated, although it will be appreciated that the teachings of the present invention are equally appliable to a wide number and variety of workpieces. A rod 27 is threadably received within the fixed jaw and carries an external crank 28. The inner end of the threaded rod carries an abutment 29 for engaging the adjacent side edge of the first workpiece 26A, and a corresponding abutment 30 is carried by the movable jaw for engaging the adjacent side edge of the third workpiece 26C. In this arrangement, three support clips are used, one for each of the workpieces. By turning the crank, a "fine" adjustment is obtained wherein the woodpieces 26A, 26B and 26C are clamped solidly between the abutments 29 and 30.

Figure 5:
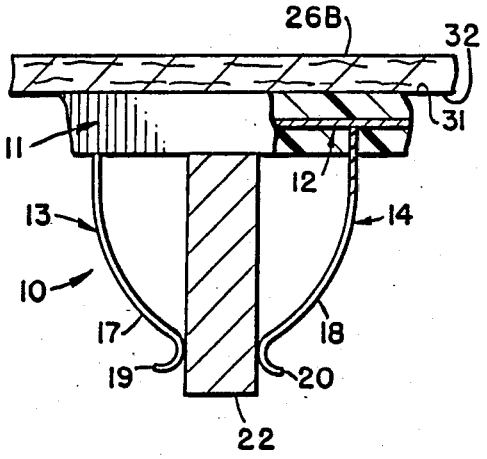
FIG. 5 is a section view, taken along the lines 5—5 of FIG. 4 and drawn to an enlarged scale, and showing the resilient legs of the support clip spread apart to straddle the longitudinal vise bar.

With reference again to FIG. 4, and with further reference to FIG. 5, the support clip is disposed between the workpiece and the longitudinal vise bar, such that the top surface 31 of the oblong bar of the support clip engages the adjacent (in this case, bottom) surface 32 of the workpiece, and such that the resilient legs 13 and 14 of the support clip are spread apart to straddle the longitudinal vise bar. The dimensions of the resilient legs, the relative thickness thereof, and the choice of material (preferably being made of good-quality spring steel), assure that the support clip will be retained on the vise bar without slippage, such that the top surface of the oblong bar of the support clip will remain in engagement with the (bottom) surface of the workpiece. The outwardly turned ends of the respective legs allow the support clip to be positioned on the vise bar, so that a downward push on the support clip will cam the respective legs outwardly, as the support clip straddles the longitudinal vise bar. Conversely, once the workpieces are removed from the vise, the support clip may be easily pulled off the vise bar by an upward movement therefrom.

Figure 6:
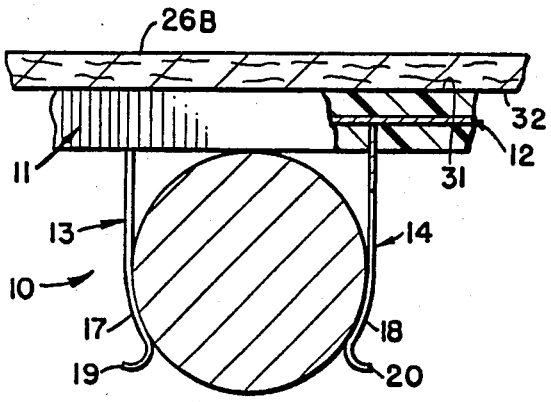
FIG. 6 corresponds substantially to a portion of FIG. 5, but illustrates the resilient legs of the support clip straddling a round vise bar (which may consist of a threaded rod).

With reference to FIG. 6, the support clip of the present invention may also be used with a round cross-sectioned vise bar 33, if desired.

Figure 7:
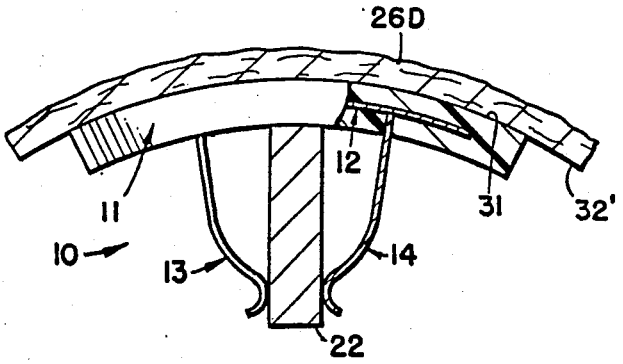
FIG. 7 corresponds substantially to FIG. 5, but illustrates how the urethane oblong bar of the support legs may bend or flex slightly to conform to a concave (or convex) adjacent surface of the woodpiece.

With reference to FIG. 7, if the bottom (or other) surface 32' of a workpiece 26D is concave (or convex) the urethane molded bar 11 will bend or flex slightly to conform to the surface 32'. Thereafter, when the support clip 10 is removed, the urethane has excellent "plastic memory", and the bar will spring back into substantially its initial or original position as shown in FIG. 2.

Figure 8:
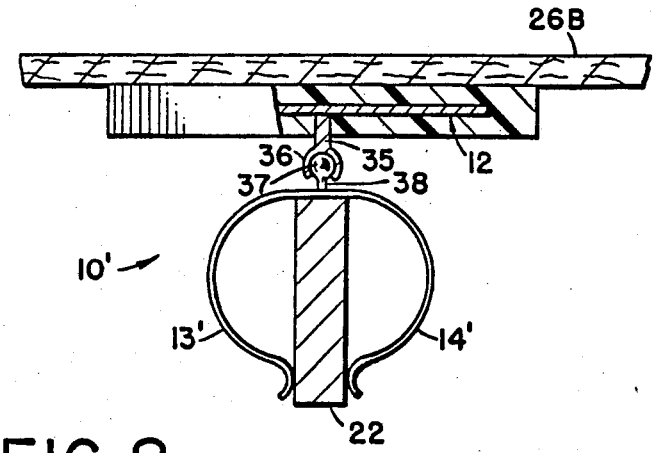
FIG. 8 corresponds generally to FIG. 5, but illustrates an alternate embodiment in which the resilient legs of the support clip may swivel slightly with respect to its oblong bar.

With reference to FIG. 8, a second embodiment 10' is illustrated in which the resilient legs 13' and 14' are connected to the oblong bar 11 by means of a swivel joint 34. In this disclosed embodiment, the swivel joint includes a stud 34 depending from the plate 12 and having a ball socket 36 on its lowermost extremity. This socket receives a spherical formation 37 on the uppermost extremity of a plate 38. This plate is formed integrally with the respective uppermost portions of the legs 13' and 14'. This swivel joint allows the legs to pivot slightly with respect to the oblong bar, thereby accommodating any misalignments between the longitudinal bar, the clamping jaws of the vise, and the workpieces, as well as accommodating any unusually-shaped workpieces. It will be appreciated, of course, that any suitable limited swivel mechanism may be employed (such as cooperating eyelets, one on the plate and the other on the resilient legs).

Figure 9:
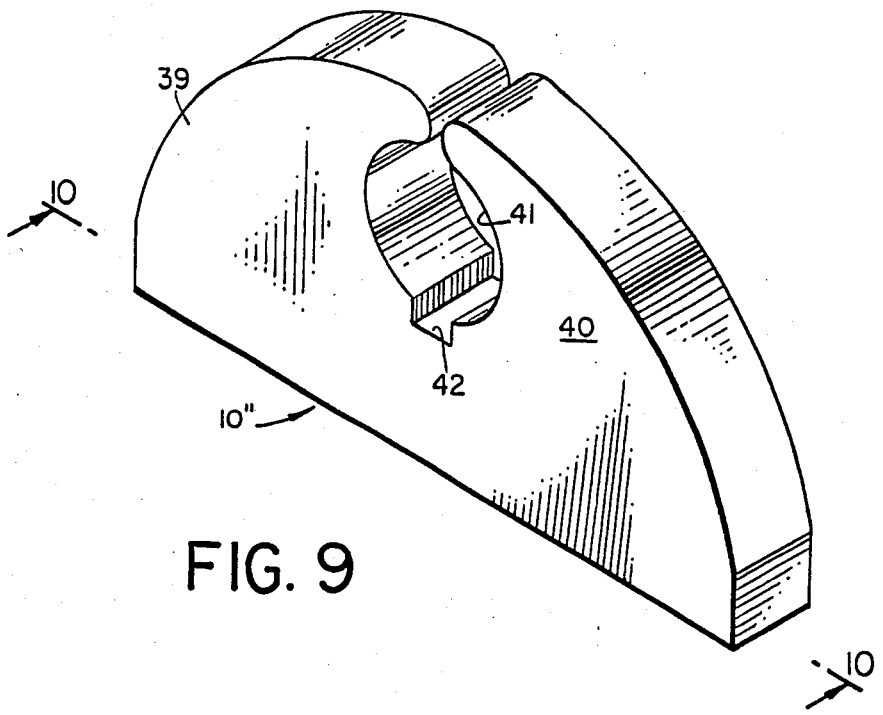
FIG. 9 is a perspective of another embodiment, corresponding generally to the showing in FIG. 1, but showing the support clip completely molded from a suitable material.
Figure 10:
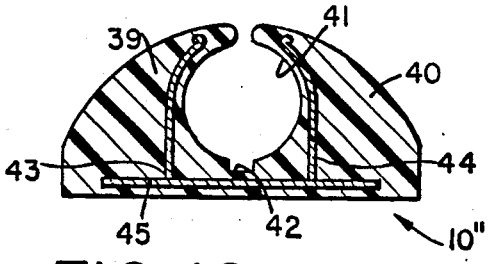
FIG. 10 is a section view, taken along the lines 10—10 of FIG. 9.

With reference to FIG. 9 and 10, a third embodiment 10'' is illustrated in which the support clip is completely molded from a suitable plastic material, such as urethane of a lesser density than that used for the oblong bar 11 of the support clip 10 of the FIG. 1 embodiment. The support clip 10'' has curved side portions 39 and 40 (simulating resilient legs), a substantially circular opening 41 therebetween, and a rectangular keyway 42 communicating with the circular opening. The molded support clip 10'', as shown in FIG. 10, has an internal supporting structure (integrally molded therein) and including respective members 43, 44 and 45. These members are preferably formed from a relatively thin spring metal material and are suitably interconnected.

Figure 11:
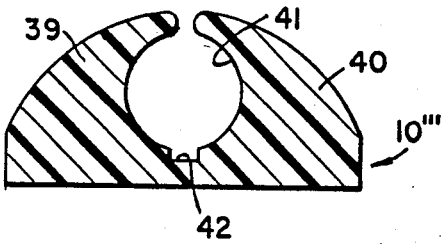
FIG. 11 corresponds substantially to FIG. 10, but shows a further embodiment in which a completely molded support clip does not have an internal spring-steel support.

With reference to FIG. 11, there is illustrated a fourth embodiment 10''' of the support clip in which the internal integrally-molded supporting structure has been eliminated.

Figure 12:
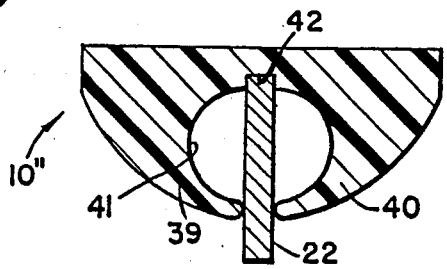
FIG. 12 corresponds substantially to FIG. 5, but shows the embodiment of FIG. 10 (or FIG. 11) used in conjunction with the longitudinal vise bar.

With reference to FIG. 12, the support clip 10'' is positioned such that the longitudinal bar 22 of the vise is received within the keyway 42.

Accordingly, the support clips of the present invention (which may also be referred to as "clamp clips") are a very desirable accessory for use with a vise, clamp or fixture, and particularly with a wood vise of the type having a longitudinal vise bar. The support clip may be installed (and subsequently removed) easily and conveniently. The plastic (or equivalent) surface on the top of the support clip assures that the workpiece will not be marred by the longitudinal bar on the vise. The oblong bar on the support clip is somewhat flexible (within certain limits) such that the bar will bend or flex to adapt to concave or convex surfaces on a given workpiece. The urethane material of the oblong bar (or its equivalent) will not stick to the workpieces nor to the vise, since the urethane is a substantially "non-stick" material which will not adhere to glues and adhesives, lacquers, varnishes or other finishes used on the work; and this is another salient feature of the present invention. By use of the support clips of the present invention, the user of the vise may effect a much closer control over the degree of clamping pressure exerted by the vise jaws on the workpiece. The support clips may be manufactured easily and economically, and their relatively low manufacturing cost assures widespread marketing and distribution of the product for use by hobbyists as well as by professional craftsmen.

A still further improvement is shown in FIG. 13–23. In these figures, an integrally-molded unitary supporting member is carried by the vise bar, lodged between the vise bar and the workpiece, and has a top surface engageable with the workpiece. This unitary member is substantially homogeneous, is substantially devoid of internal reinforcements, and has a central recess having a plan outline corresponding substantially to a cross-section of the vise bar.

Figures 13, 14, 15, 16, 17, 18, 19, 20, 21:
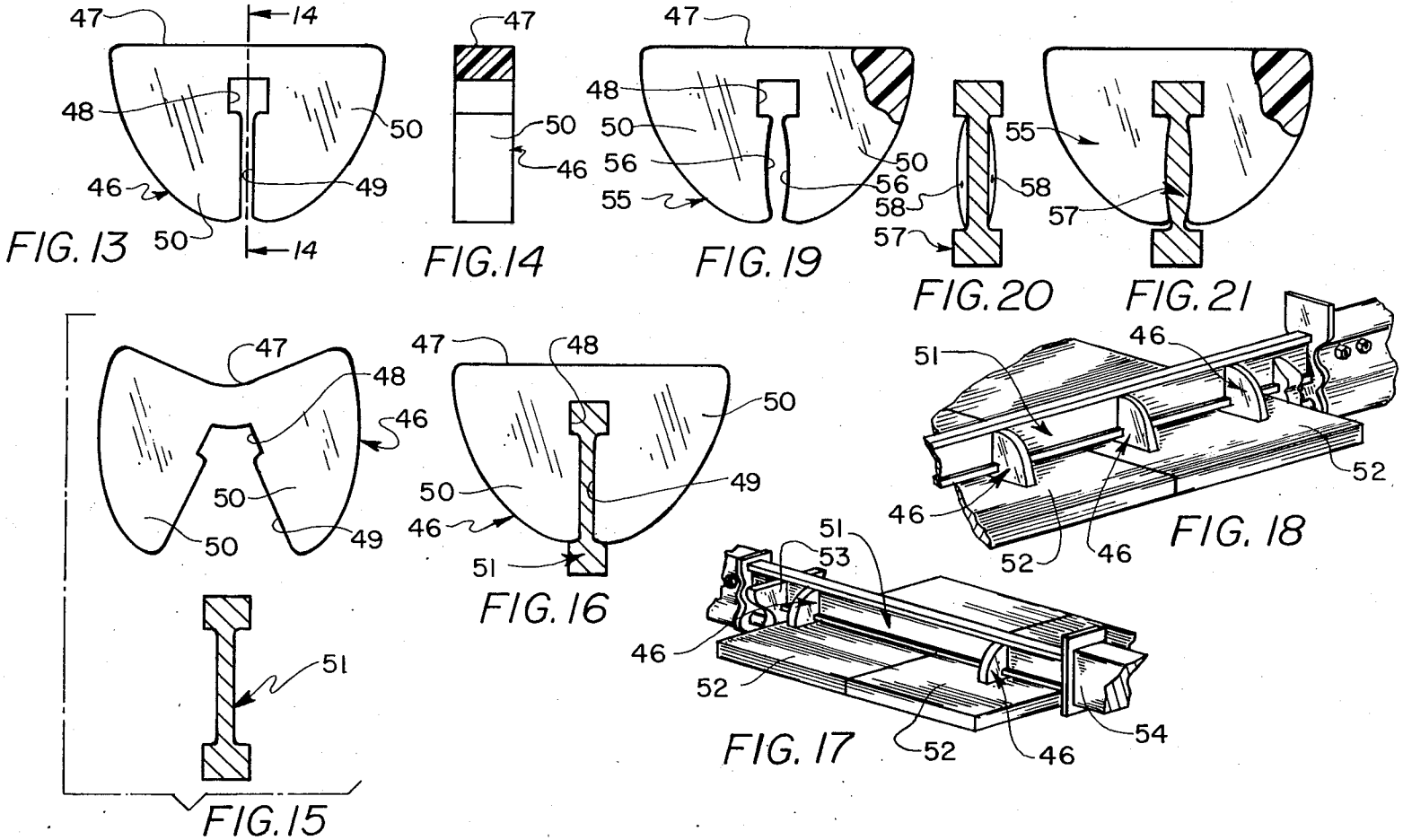
FIG. 13 is a first embodiment of a still further improvement, wherein the central recess in the integrally-molded unitary member has a substantially T-shaped plan outline to conform to the complementary cross-section of a particular vise bar.
FIG. 14 is a section view thereof, taken along the lines 14—14 of FIG. 13.
FIG. 15 is an exploded view, showing the I-beam cross-section of the vise bar, and further showing the bifurcated legs of the unitary member (of FIG. 13) spread apart so as to be mounted on to the vise bar laterally thereof.
FIG. 16 shows the unitary member of FIG. 13 removably mounted on the vise bar shown in FIG. 15, the member having an inherent resiliency for gripping the vise bar.
FIG. 17 is a perspective view of two of the unitary members of FIG. 13 carried by a complementary vise bar and having respective flat top surfaces engaging the respective workpieces.
FIG. 18 is a further perspective view, showing three of the unitary members of FIG. 13 in a typical application thereof.
FIG. 19 is a second embodiment of the still further improvement, corresponding substantially to FIG. 13, but having confronting concave surfaces on the stem portion of its T-shaped recess.
FIG. 20 is a cross-section of a further vise bar for which the unitary member of FIG. 19 is intended to be used, the section corresponding substantially to the I-beam cross-section (of FIG. 15) but showing laterally-projecting convex ribs on the vise bar.
FIG. 21 corresponds substantially to FIG. 16, but shows the unitary member of FIG. 19 mounted on its complementary vise bar.

With reference to FIGS. 13–16, illustrating a first embodiment of the still further improvements, the unitary member 46 is substantially semi-circular and has a substantially flat top 47 engageable with the workpiece. The unitary member further has a T-shaped central recess 48 and is slotted, as at 49, to form a pair of bifurcated resilient legs 50 in the unitary member. These legs 50 may be spread apart, as shown in FIG. 15, for mounting the unitary member on to a vise bar 51 laterally thereof. The resilient legs of the member then spring back, as shown in FIG. 16, so that the member straddles the vise bar 51. The vise bar has an I-beam cross-section, a portion of which is complementary to the plan outline of the T-shaped central recess in the unitary member. In an intended commercial model, the thickness of the unitary member (as shown in FIG. 14) is 5/16".

The unitary member 46 (of the embodiment shown in FIGS. 13–16) may be used with a "JORGENSEN" I-beam bar, Style 72 made by the Adjustable Clamp Company of Chicago, Ill., as well as the "WETZLER" Style No. 640 I-beam.

With reference to FIG. 17, three workpieces 52 are clamped between cooperating jaws 53, 54 on the I-beam vise bar 51. In this application, two unitary members 46 are used. In FIG. 18, three unitary members 46 are used.

With reference to FIGS. 19–21, a second embodiment of the still further improvements is illustrated. Here, the unitary member 55 corresponds substantially to the member 46 (of FIG. 13) but stem portion of the T-shaped recess 48 is scalloped to form a pair of concave surfaces 56 confronting one another. This unitary member 55 is intended to be used with a vise bar 57, which corresponds substantially to the I-beam vise bar 51 of FIG. 15, but has a plurality of laterally-projecting convex ribs (as shown in FIG. 20) complementary to the respective concave surfaces on the unitary member. (This is the old style "WERTLER" I-beam bar, which has been replaced by their Style No. 640.)

The unitary member 55 (of the embodiment shown in FIG. 19–21) may be used with the "old" style $\frac{5}{8}\times1\frac{1}{2}$" "WETZLER" I-beam.

Figure 22:
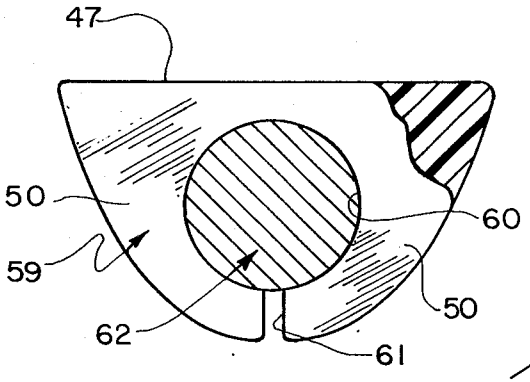
FIG. 22 is a third embodiment of the still further improvement, wherein the central recess in the unitary member has a substantially circular plan outline to conform to its complementary vise bar or rod.

With reference to FIG. 22, a third embodiment of the still further improvements is illustrated. Here, the unitary member 59 has a central recess 60 whose plan outline is substantially circular and communicates with a slot 61, thereby forming the resilient bifurcated legs. This unitary member 59 cooperates with a complementary-formed vise bar or rod 62 having a substantially circular cross-section.

The unitary member 59 (of the embodiment shown in FIG. 22) may be used with any 3/4" I.D. ($1\frac{3}{4}$" O.D.) pipe clamp, or any $\frac{1}{2}$" I.D. (27/32 " O.D.) pipe clamp, currently available on the market.

Figure 23:
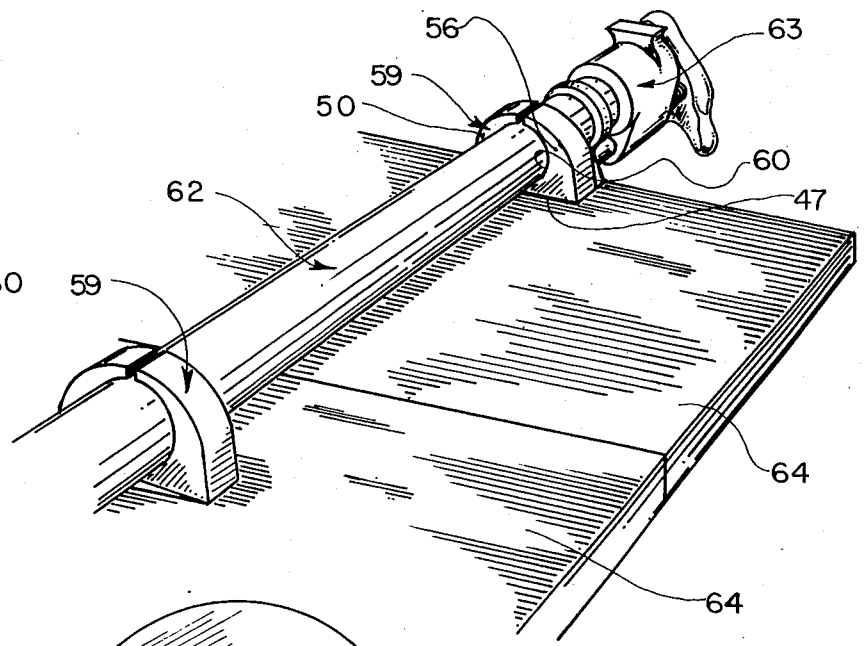
FIG. 23 is a perspective view of a typical application of the unitary member shown in FIG. 22.

A typical application is shown in FIG. 23. Here, the unitary members 59 are removably mounted on the vise bar 62 of a pipe clamp 63. The flat top surfaces 47 of the unitary members (one of which is shown completely and the other of which is shown partially) rest flush against the respective workpieces 64.

Figure 24:
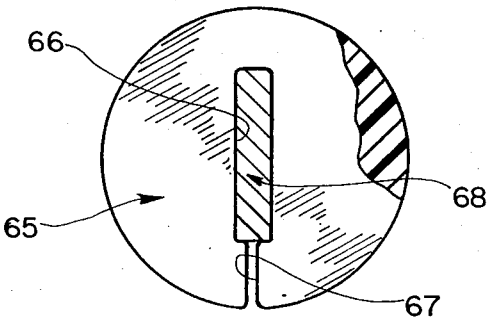
FIG. 24 is a fourth embodiment of the still further improvement, wherein the unitary member is substantially circular in plan outline, and wherein the plan outline of the central recess in the unitary member is substantially rectangular.

With reference to FIG. 24, a fourth embodiment of the still further improvement is illustrated. Here, the unitary member 65 is itself substantially circular in plan outline, and its central recess 66 is substantially rectangular and communicates with a slot 67, forming the resilient bifurcated legs, for cooperation with the complementary vise bar 68.

The unitary member (of the embodiment shown in FIG. 24) may be used with a $5/16\times1\frac{1}{4}$" "WETZLER" bar clamp, or with a $\frac{1}{4}\times\frac{3}{4}$", or $5/16\times1$", or $5/16\times1\frac{3}{8}$" "JORGENSEN" bar clamp, as well as many older models made by other manufactures and having the same proportions.

Additionally, if the outer configuration of the member 65 is not circular, but begins to resemble the outer configuration of the previous embodiments of FIGS. 13–22, then the member 65 may be a $\frac{1}{4}\times1\frac{1}{4}$" "RECORD" sash clamp or the $5/16\times1\frac{3}{8}$" "JORGENSEN" bar clamps, types 40, 60, and 61.

Figure 25:
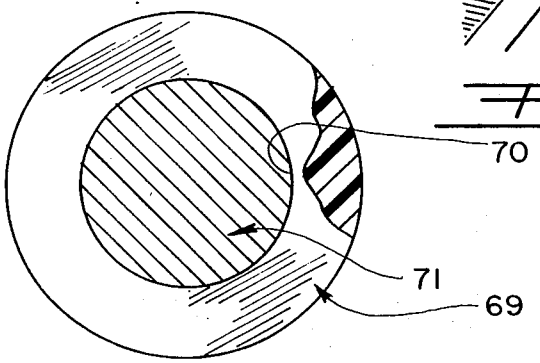
FIG. 25 is a fifth embodiment of the still further improvement, wherein the unitary member is substantially toroidal and has a circular recess, so that the member is received endwise over the vise bar or rod.

With reference to FIG. 25, a fifth embodiment of the still further improvements is illustrated. Here, the unitary member 69 is substantially annular or toroidal and has a central recess 70 which is substantially circular to conform to the round cross-section of the vise bar 71. In this embodiment, the unitary member 69 is adapted to be received end-wise over the vise bar 71.

The unitary member 69 (of the embodiment shown in FIG. 25) may be used with any $\frac{1}{4}$" I.D. (1 1/16" O.D.) or any $\frac{1}{2}$" I.D. (27/32" O.D.) pipe clamp currently available on the market.

In operation, a selected unitary member is mounted at each end of the vise bar, inside the conventional clamp pads. For multi-piece edge gluing, one selected unitary member is used over the center of each board to support and stabilize the workpiece. For even better results, the members may be alternated over and under the workpiece to equalize the pressure of the clamps.

The unitary members (for both bar and pipe clamps) has a flexible $\frac{5}{8}\times2\frac{1}{2}$" flat (top) surface to stabilize the bar and workpiece. For lightweight bar clamps, the unitary member is round ($1\frac{1}{2}$" to $2\frac{1}{8}$" in diameter and $\frac{5}{8}$" thick) to facilitate a rotation of the clamp to any angle. This is another important feature of the present improvements.

The present improvements facilitate an entire product line of twelve models intended for the commercial market. These models are available for all popular bar clamps, pipe clamps, lightweight and hi-speed clamps, and long jaw style clamps used by woodworkers, hobbyists, and professional craftsmen. Each of the models is available in a different bright color, easy to match, and tough to lose.

The unitary members of the present improvement are integrally molded from a 100% memory urethane which will retain its shape indefinitely under daily use. They can be wiped clean with water or mild solvents, if soiled. The unitary members will not mar, dent, scratch, scar, bruise, discolor, or stain the wood. Moreover the members (preferably being molded from urethane) will not stick to most finishes or adhesives, as previously noted.

The members may be snapped easily on to the bar clamp, slid quickly to the desired place, and snapped off effortlessly. The members provide a soft, flexible 5/16" cushion between the vise bar and the wooden workpiece; and the members stabilize the bar and reduce or eliminate bowing. This is especially important for relatively thin materials.

Obviously, many modifications may be made without departing from the basic spirit of the present invention. For example, the workpieces may be stainless steel or other materials whose surface is to be protected. Accordingly, within the scope of the appended claims, the invention may be practiced other than specifically disclosed herein.

What is claimed is:

1. In a clamp including an elongated bar having a substantially uniform cross-section, wherein the clamp is adapted to engage and exert pressure against the respective outer portions of a plurality of workpieces, and wherein the workpeices have respective inner portions abutting one another, the improvement comprising at least one unitary supporting member integrally molded from a plastic material and adapted to be lodged between the bar and one of the workpieces, the supporting member having a central recess provided with a plan outline corresponding substantially to the cross-section of the bar, such that the supporting member is substantially infinitely slidably adjustable along the length of the elongated bar, the supporting member gripping the bar and being carried thereon, the supporting member being relatively flexible for easy mounting and demounting on the bar, and the supporting member having a substantially flat portion adapted to engage the surface of the one workpiece, wherein the supporting member provides a substantially soft, flexible cushion between the bar and the workpiece and substantially prevents the bar from touching the workpiece, thereby preventing the bar from marring the workpiece, and wherein the supporting member tends to preclude bowing of the workpieces, further including a slot formed in the supporting member opposite to the flat edge and communicating with the central recess therein, thereby forming a pair of bifurcated resilient legs in the supporting member, wherein the legs may be spread apart to mount the member on the bar, whereby the member has inherent resiliency, so that the legs spring back to grip the bar.

2. In combination with a clamp having a clamp bar and further having respective jaw means for clamping at least one workpiece therebetween, an integrally-molded unitary supporting member carried by the clamp bar, lodged between the clamp bar and the workpiece, and having a surface engageable with the workpiece, the member being substantially homogeneous and devoid of internal reinforcements, the member being relatively soft and substnatially flexible, such that the member may be easily mounted on the bar and demounted therefrom, and such that the member provides a cushion between the bar and the workpiece, and the member including a central recess having a plan outline corresponding substantially to a cross-section of the vise bar, wherein the member substantially embraces the clamp bar, wherein the clamp bar is substantially elongated and has a uniform cross-section, and wherein the member is substantially infinitely slidably adjustable along the length of the clamp bar, wherein the member has a flat top surface and is substantially semi-circular; wherein the flat surface engages the workpiece and has a length substantially equal to the greatest width of the member, wherein the central recess is slotted, thereby forming a pair of resilient legs in the member; wherein the legs may be spread apart to mount the member on the clamp bar, whereby the plastic member has inherent resiliency, so that the legs spring back to grip the clamp bar; and wherein the plan outline of the central recess in the member is substantially T-shaped to conform to the cross-section of the clamp bar.

3. The combination of claim 2, wherein the T-shaped recess includes an elongated stem portion, and wherein the stem portion has concave inner surfaces confronting one another.

4. The combination of claim 2, wherein the member has a flat top surface and is substantially semi-circular; wherein the flat surface engages the workpiece and has a length substantially equal to the greatest width of the member, wherein the central recess is slotted, thereby forming a pair of resilient legs in the member; wherein the legs may be spread apart to mount the member on the clamp bar, whereby the plastic member has inherent resiliency, so that the legs spring back to grip the clamp bar; and wherein the plan outline of the central recess in the member is substantially rectangular to conform to the cross-section of the clamp bar.

5. The combination of claim 2, wherein the member has a flat top surface and is substantially semi-circular; wherein the flat surface engages the workpiece and has a length substantially equal to the greatest width of the member, wherein the central recess is slotted, thereby forming a pair of resilient legs in the member; wherein the legs may be spread apart to mount the member on the clamp bar, whereby the plastic member has inherent resiliency, so that the legs spring back to grip the clamp bar; and wherein the plan outline of the central recess in the member is substantially circular to conform to the cross-section of the vise bar.

* * * * *